US006360710B1

(12) United States Patent
Christenson et al.

(10) Patent No.: US 6,360,710 B1
(45) Date of Patent: Mar. 26, 2002

(54) ROCKET PISTON INTERNAL COMBUSTION ENGINE

(76) Inventors: Howard W. Christenson, 128 W. 73rd St., Indianapolis, IN (US) 46260; Roger C. Christenson, 11240 College Ave., Carmel, IN (US) 46032

( * ) Notice: Subject to any disclaimer, the term of this patent is extended or adjusted under 35 U.S.C. 154(b) by 0 days.

(21) Appl. No.: 09/733,658

(22) Filed: Dec. 8, 2000

(51) Int. Cl.[7] ..... F02F 3/00
(52) U.S. Cl. ..... 123/193.6
(58) Field of Search ..... 123/193.6, 78 A, 123/48 AA; 92/216

(56) References Cited

U.S. PATENT DOCUMENTS

| | | | | |
|---|---|---|---|---|
| 3,311,096 A | | 3/1967 | Bachle et al. | |
| 4,128,092 A | * | 12/1978 | Yokota et al. | 123/193.6 |
| 4,359,976 A | * | 11/1982 | Steele | 123/193 |
| 4,599,772 A | * | 7/1986 | Graham | 123/193.6 |
| 4,776,308 A | * | 10/1988 | Blackburn | 123/193.6 |
| 5,724,933 A | * | 3/1998 | Silvonen et al. | 123/193.6 |
| 5,794,582 A | * | 8/1998 | Horiuchi | 123/193.6 |
| 5,970,944 A | * | 10/1999 | Kawamura | 123/48 AA |
| 6,035,814 A | | 3/2000 | Christenson et al. | |

OTHER PUBLICATIONS

John B. Heywood, "Internal Combustion Engine Fundamentals (selected various pages: total of 12 pages),".

* cited by examiner

*Primary Examiner*—Marguerite McMahon

(57) ABSTRACT

An improvement to the crank piston for reciprocating operation within a cylinder of any internal combustion engine includes a short cylinder defining a recess under a piston crown port plate closing the recess to define a bounce gas chamber therein. A rocket piston disc is disposed for reciprocation within the bounce gas chamber. The plate defines a plurality of openings therethrough to permit communication of combustion gas between the engine cylinder and the chamber above the piston disc. The rocket piston disc is sized to allow combustion gas to leak behind the disc into the bounce gas chamber. The disc operates as a rocket piston by first trapping a fraction of peak pressure as bounce gas between the disc and the bottom of the cylinder, next compressing this bounce gas in response to auto-ignition gas pressure exerted through the ports, and then providing supplemental crank power as the rocket piston disc is pushed upward to seat by the increased pressure bounce gas. In one embodiment, a support member in the form of a conical spring can be provided to hold the rocket piston disc near a seat in the port plate. The spring force rate may be increased to raise bounce pressure if desired.

20 Claims, 1 Drawing Sheet

ROCKET PISTON INTERNAL COMBUSTION ENGINE

BACKGROUND OF THE INVENTION

The present invention relates to internal combustion engines, such as spark ignition and diesel engines. More particularly, the invention contemplates systems and methods for direct conversion of combustion pressure to drive engine pistons.

Combustion pressure and temperature knock limits are responsible for major heat losses in all current internal combustion engines. All combustion is progressive, whether originating from spark ignition or minimum temperature auto-ignition. When combustion occurs, the progressive flame expands from the point of ignition as the temperature rises. When the burn energy rate exceeds the heat transfer rate, the temperature within the engine cylinder rises exponentially until explosion expansion of all the end gas occurs. This explosion expansion generates a high-pressure spike followed by instant collapse. This event yields the "engine knock" phenomenon. Heretofore, engine knock control has been limited to reducing compression pressure or using high-octane fuel.

Combustion at the minimum temperature of auto-ignition, between 400–600° C., does not produce knock if expansion yield can limit peak pressure. Increasing yield works to prevent knock, so providing additional constant volume gas yield above minimum temperature auto-ignition can increase the expansion rate until all the fuel is burned, even above 600° C.

This latter principle was employed in my earlier invention, as described in U.S. Pat. No. 6,035,814, issued on Mar. 14, 2000. In particular, this patent described my "rocket piston" for use in an internal combustion engine. In this invention, the rocket piston operated against bounce gas behind the piston. In accordance with the invention, the bounce gas would speed up yield at limited pressure until all the end gas within the cylinder is burned, making engine knock impossible within the combustion cavity. With this rocket piston expansion, instant conversion of all the high-pressure auto-ignition expansion to peak pressure with more rapid yield decimates heat loss, while insuring maximum combustion power. Under these conditions, all of the combustion gas expands adiabatically, with practically no fire during expansion to exhaust.

Internal combustion engines were greatly improved when they changed from burning fuel to make steam to direct conversion of combustion pressure to drive engine pistons. However, the crank-controlled piston, which is near ideal for steam, is too slow to match acceleration auto-ignition rates above 600° C., causing exponential expansion engine knock Knock may be controlled with limited pressure or faster yield rates at high pressure obtained by the rocket piston gas cushioned energy expansion accumulator at higher temperatures. Thus, all current internal combustion engines must use high octane fuel or lower compression ratios, losing over eighty percent of heat combustion energy during city traffic driving at part throttle because the hot combustion gas just sits until slow piston motion expands the charge. Moreover, medium pressure combustion flame temperatures toast engine exhaust gas thus forming nitrous oxide (NOx) pollution that must eventually be removed by a catalytic converter.

All fuel-injected engines have some evaporated air-fuel mixture for spark ignition, and some liquid fuel can always wet the piston crown and ports. This fuel is ignited by flame evaporation and progressive auto-ignition burning as the rocket piston yields. This principle is employed for all engines including supercharged and improved diesel engines using the rocket piston and fuel injection. My prior rocket piston has taken a large step in producing direct conversion as fast as the fuel can burn speeding up yield rate above combustion expansion rate near top-dead-center, with no slow flame that can form NOx air pollution.

The addition of the rocket piston gas cushion yield in the combustion cavity provides instant conversion of all the combustion gas above the combined compression gas and bounce gas volumes; with near 100% efficiency as the rocket piston reciprocates with substantially no friction and transfers peak pressure and temperature energy through the thin wall piston. The bounce gas yield and instant conversion expansion provides the bonus power, and operates as a knock limiter through the fast gas-to-gas addition to the engine cycle. The rocket piston remains seated during the scavenge stroke. The lift off pressure is higher than the seating pressure due to valve area hysteresis.

SUMMARY OF THE INVENTION

In accordance with the present invention, an improvement to the crank piston for reciprocating operation within a cylinder of any internal combustion engine is provided. In one aspect of the invention, this improvement comprises a short cylinder defining a recess under a piston crown port plate closing the recess to define a bounce gas chamber therein. The plate defines a plurality of ports or openings therethrough for permitting communication of combustion gas between the engine cylinder and the chamber above a rocket piston disc disposed within the short cylinder.

In another feature, a rocket piston disc sized to reciprocate within the short cylinder operates beneath the port plate closing the ports. The piston disc translates in response to combustion gas passing through the ports. The disc operates as a rocket piston disc by first trapping a fraction of peak pressure in bounce gas between the disc and the bottom of the cylinder, compressing this bounce gas in response to auto-ignition gas pressure exerted through the ports, then providing supplemental crank power as the rocket piston disc translates upward to seat, trapping a fraction of peak pressure plus valve seat hysteresis area for the next cycle.

In one embodiment, a support member in the form of a conical spring can be provided to hold the rocket piston near a seat in the port plate. The spring force rate may be increased to raise bounce pressure if desired.

Preferably, the crown plate defines about twenty-one (21) ports or openings therethrough large enough to avoid quenching the flame for non-quenching free flow. In one embodiment, the plate includes one opening at its center, with the remaining openings uniformly distributed around the plate. In another embodiment, particularly for use with center fire injectors, the center opening may be eliminated.

The rocket piston disc is preferably formed of a heat-resistant metal. For example, the disc can be composed of chrome-nickel, stainless steel, or titanium material. Preferably, the disc has a thickness of about 0.05–0.06 inches (1.27–1.52 mm.). The weight of the disc is preferably in the range of about 0.176 lbs. for a stainless steel rocket piston, and about 0.079 lbs. for a titanium 4.0 inch piston.

In operation, combustion gas passes through the ports in the top plate to exert pressure against the rocket piston disc. When combustion pressure exceeds the trapped bounce gas pressure force beneath the piston disc, the rocket piston disc lifts off its seat with rapid acceleration and nearly perfect balance with practically no leak or friction. Trapped expansion pressure rises to peak combustion pressure, then all the transferred compression energy recycles, driving the crank piston with about 100% efficiency until the rocket piston disc re-seats. The efficiency is appreciably higher than any other engine design because the piston disc reciprocates with essentially no friction and in part because the heat transfer through the rocket piston disc to the bounce gas is greater than the heat loss to the crank piston through the bounce gas.

It is one object of the invention to provide an engine crank piston with an additional instant conversion rocket piston bounce gas in a short cylinder cushion in the top of the crank piston, to provide primary yield rates matching combustion expansion rates making knock impossible while burning all the end gas fuel for power in one millisecond.

It is a further object of the invention to provide an engine piston capable of achieving greater thermal and combustion efficiency by instant conversion to bounce gas compression by one millisecond. Another object is to provide an internal combustion engine cylinder cycle that minimizes or eliminates various pollutants, such as NOx emissions which are not formed in one millisecond flame time.

It is one object of the invention to provide a Bellville spring to increase the bounce pressure to always match any peak pressure. The addition of the additional constant volume bounce gas cushion and rocket piston check valve provides additional constant volume yield above minimum temperature auto-ignition high pressure for maximum constant volume efficiency and faster yield until all the end gas is burned. This yield is never exceeded by combustion expansion making knock impossible at high pressure and permitting instant conversion of all the flame expansion energy until all the end gas fuel is burned early in the cycle to accommodate any homogeneous or heterogeneous engine cycle.

These and other objects and benefits will become apparent upon consideration of the following written description together with the accompanying figures.

DESCRIPTION OF THE PREFERRED EMBODIMENT

Figure 1:
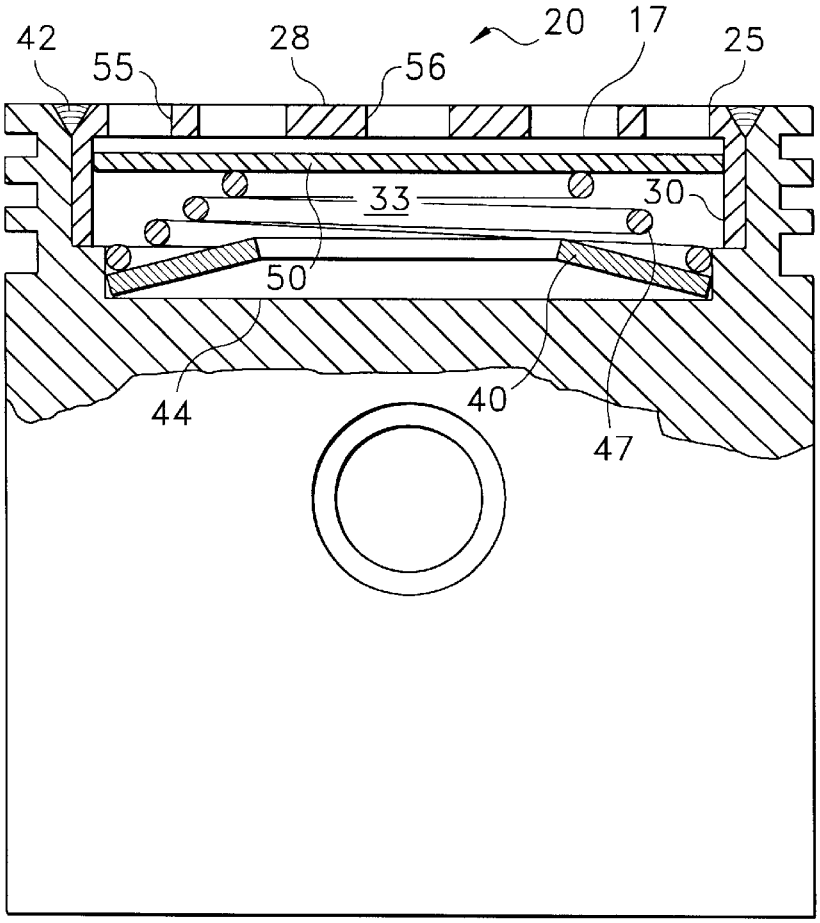
FIG. 1 is a side cross-sectional view of an engine crank piston incorporating a rocket piston assembly according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention contemplates a modification for a standard engine internal combustion engine, so it can add instant conversion gas-to-gas at higher pressure yield rates in one millisecond, making knock impossible, doubling efficiency and eliminating air pollution. One embodiment of the present invention contemplates a rocket piston assembly 20 situated in the crown 17 of the reciprocating crank piston 15. More particularly, the piston crown 17 is modified to define a port plate valve seat and a short cylinder. Preferably, the valve seat 25 is in the form of a cup having a valve plate 28 and an integral circumferential cylinder 30. The valve seat 25 defines a bounce pressure cavity or chamber 33 between the seat and the crown of the crank piston 15.

The valve seat 25 can be engaged with the piston crown in several ways. A threaded engagement can then be provided between the short cylinder 30 and a piston recess 44 formed in the crank piston crown. Thus, the valve seat can be threaded onto the top of the crank piston. Alternatively, or in addition, the engagement between the cylinder 30 and recess can be welded using a circumferential weld bead 42 around the joint.

In accordance with one aspect of the present invention, a rocket piston disc 50 in the form of a thin disc is disposed to freely translate up and down within the chamber 33. The rocket piston 50 has an outer diameter that is less than the inner diameter of the cylinder 30, to thereby define a gas leakage path (running clearance) around the rocket piston disc 50. As with the prior inventive rocket piston of my U.S. Pat. No. 6,035,814, combustion gas passes around the rocket piston disc 50 to maintain about three-quarters peak pressure for bounce gas pressure below the piston disk check valve disc to match constant throttle because the gas is always trapped during peak pressure expansion. This bounce gas yields, thereby limiting peak combustion pressure, and eventually transferring all the rocket piston compression and heat expansion to drive the engine, as described in more detail below.

Preferably the rocket piston disc 50 is supported by a spring 47. In the most preferred embodiment, this spring is a conical spring that is configured to locate the rocket piston disc 50 within the chamber 33. A conical spring is used so that it can be compressed as flat as possible upon the downward travel of the rocket piston disc 50. It preferably never bottoms out. The spring stiffness can increase peak pressure, and maintain the piston seated near the valve seat 25 in the absence of sufficient bounce pressure gas. With this support member, the rocket piston disc 50 is always ready for action, rather than inertly seated at the base of the bounce gas chamber after long storage periods. A Belleville spring 40 can be added below the spring 47 to act as a limit stop for the rocket piston disc, so more gas will flow to the gas cushion.

In the operation of the novel engine, the rocket piston disc 50 must be free to reciprocate within the chamber 33. In order to accomplish this movement, the seat plate 28 is configured with a plurality of gas flow ports 55 passing therethrough. In one specific embodiment, twenty-one such ports can be provided in the valve seat plate 28. The center port 56 can be eliminated for engines where the injector is centrally located at the cylinder head end.

Figure 2:
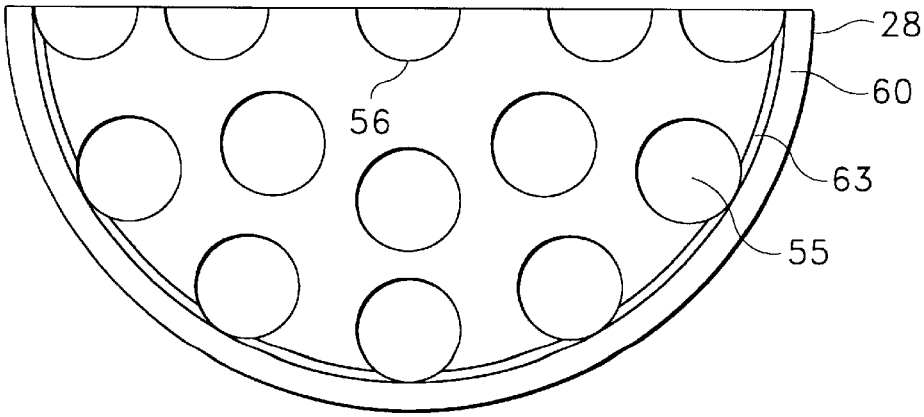
FIG. 2 is a bottom elevational view of the rocket piston valve seat shown in FIG. 1.

As depicted in the bottom view of FIG. 2, the valve seat plate 28 is configured so that the ports 55, 56 pass completely through the seat. This figure illustrates a preferred arrangement of the seat and ports to ensure free flow of gas through the valve seat onto the top surface of the rocket piston disc. The valve seat plate 28 defines a piston seat surface 60 against which the rocket piston disc 50 is seated during portions of the engine cycle. In addition, a pressure groove 63 can be defined around the interior diameter of the valve seat, preferably communicating with or intersecting the gas flow ports 50 situated near the perimeter of the valve seat. This pressure groove limits the valve seat hysteresis lift area.

The addition of the rocket piston disc 50 in the piston crown 28, together with bounce pressure trapped in the chamber 3 below the rocket piston disc produce a 3-stage expansion cycle with instant conversion at any engine speed that can at least double the available power for trucks and automotive applications and potentially quadruple part throttle efficiency. The pressure chamber 33 beneath the rocket piston disc 50 is always filled with bounce gas that is trapped at a fraction of the peak pressure from the previous combustion cycle. The entire bounce gas cushion yield is combined with the combustion auto-ignition constant yield for high rapid yield thermal efficiency as all the fuel is burned with high pressure turbulence as the combustion pressure rises to its rounded peak, at approximately 10 degrees past top dead center.

At this point, all of the gas expands, driving the crank piston downward until the bounce pressure seats the rocket piston with no additional fire. At this point, all of the combustion gas expands adiadatically to exhaust with no fire and no pollution, primarily because the auto-ignition is fast and burns all of the hydrogen within the compression gas near peak pressure. Then excess oxygen incinerates all of the carbon monoxide, carbon and other residual gases with no slow flame to toast exhaust gas to form NOx pollution. Thus, the large combustion and bounce cushion volume yields and expands all of this stoichiometric gas charge with single, double and triple two-piston expansion as smooth as steam with the combined gas-to-gas-to-mass rapid expansion cycle.

During the combustion process, the expanding combustion gas accelerates the rocket piston disc with perfect balance, to peak pressure. Then during the expansion of all the gas, the rocket piston disc reseats, trapping an adjusted bounce gas charge for the next cycle. Then all the combustion gas expands to exhaust.

On every combustion cycle, the crank piston 15 rises with the primary compression ratio between 10:1 and 16:1, until the combustion pressure exceeds the bounce gas pressure within the pressure chamber 33. At that point, the bounce gas volume is combined with the primary compression volume to speed up the yield rate and slow down the burn rate high-pressure spike that ordinarily occurs in the current combustion cycle. The rapid yield is accomplished by instant increase in volume when the piston disc 50 is lifted off its seat.

Since the rocket piston disc yield is very fast, it is impossible for combustion expansion to exceed the two-piston high volume yield rate, making knock spikes impossible as the bounce gas cushion expands the pressure to volume ratio to a rounded peak. An extra efficiency bonus is accomplished by the engine modified in accordance with the present invention because the rocket piston expansion is in addition to the crank piston expansion. The rocket piston disc 50 transfers all of the bounce gas high pressure energy with instant conversion gas-to-gas exchange, with practically no leak or friction (because there are no side loads exerted on the piston disc 50).

Once all the fuel is burned at peak pressure, all the gas expands with no fire, thus driving the crank piston. The bounce gas returns the rocket piston disc 50 against the valve seat plate 28, trapping an adjusted fraction of the peak pressure gas cushion within the bounce pressure chamber 33 for the next combustion cycle. Then, the high volume combustion gas pressure adiabatically driving the crank piston until exhaust.

The passage of combustion gas between the rocket piston disc and the cylinder combustion chamber is accomplished through the gas flow ports 55, 56 in the piston valve seat plate 28. These gas flow ports 55, 56 also serve another function in accordance with one aspect of the invention. At idle, stratified fuel is injected into the combustion chamber. All of the evaporated fuel ignites with the spark or at the minimum temperature auto-ignition. At greater throttle positions, part of the stratified liquid fuel wets the valve seat 28 and the gas flow ports 55. When minimum temperature auto-ignition occurs to lift the rocket piston disc off of the piston seat 60, turbulent jets of fuel and fire pass through the gas flow ports 55, thereby evaporating all of the remaining fuel. The resultant gas auto-ignition combustion expansion drives the rocket piston disc, bounce gas in chamber 33, and the crank piston, further compressing the trapped bounce gas within the pressure chamber 33 to limited peak pressure, with the fastest, most efficient, constant volume, linear thrust cycle possible. This compression auto-ignition expansion can occur in a fraction of a millisecond, because the rocket piston has 100 times the area and about the same mass of a bullet.

Thus, the gas flow ports 55, 56 improve the combustion efficiency of the engine by extending the stratified fuel burning rate after rocket piston disc lift-off. In one aspect, the rocket piston disc 50 provides a two-stage combustion. This two-stage combustion is assured as the rocket piston disc 50 does not move until the minimum temperature auto-ignition pressure exceeds the bounce gas pressure behind the piston disc 50 in the pressure chamber 33. All end gas fuel is ignited by the "blow-torch" flame jets passing through the gas flow ports 55, 56, thereby increasing the combustion efficiency with high turbulence.

In the preferred embodiment, the rocket piston disc 50 is a thin chrome-nickel, heat-resistant stainless, or titanium material. Preferably, the disc has a thickness of about 0.05–0.06 inches for low mass. For a four-inch steel disc, this thickness produces a weight of about 0.176 lbs., while a similarly sized titanium disc can weight about 0.079 lbs.

In accordance with the present invention, gas-to-gas energy transfer can be accomplished as fast as auto-ignition can burn. This rapid transfer makes engine knock impossible and eliminates all slow-burn pollution phenomenon. Moreover, the provision of the bounce pressure chamber 33 and the accompanying large gas cushion always limits the peak combustion pressure and rounds off the peak combustion pressure within the engine cylinder. The high pressure gas-to-gas-energy transfer produces no rocket piston side loads, which means no friction occurs between the rocket piston disc 50 and the cylinder wall 30.

The present invention burns all of the fuel injected into the cylinder above the minimum auto-ignition temperature with rapid gas-to-gas expansion, eliminating the high constant-volume pressure spike that causes knock in current internal combustion engines. The addition of the rocket piston disc 50 and the balanced pressure chamber pressure 33 allows the trapped bounce gas cushion to yield when the combustion pressure exceeds the bounce cushion pressure. The bounce gas instantly adds trapped expansion volume to the compression volume with no drop in pressure. This pressure exchange allows all of the stratified fuel to be burned in one millisecond, then the excess oxygen incinerates all the residual fuels and carbon monoxide, leaving no slow-flame to toast exhaust gas to form NOx air pollution.

The rocket piston of the present invention provides significant advantages over conventional internal combustion engines. For example, all combustion occurs at a higher expansion ratio. As explained above, the rocket piston disc and the gas flow ports 55, 56 within the piston valve seat plate 28 provide gas-to-gas yield speed to match the auto-ignition pressure to accomplish adiabatic energy transfer in a one millisecond combustion time. The large bounce gas volume increases yield rate limiting exponential combustion acceleration limiting the peak pressure within the combustion chamber, so the addition of the yielding rocket piston eliminates knock and nitrous oxide air pollution. Moreover, all energy transferred to the bounce gas cushion at peak combustion pressure stores high thermal expansion energy, then all of the gas expands to drive the crank piston until the rocket piston disc seats. Then all the combustion gas expands a third time to exhaust, producing high efficiency with minimum heat loss in three steps on each combustion cycle, in about one millisecond with adiabatic instant conversion until all the fuel is burned, doubling expansion volume with the current fuel.

While the invention has been illustrated and described in detail in the drawings and foregoing description, the same is to be considered as illustrative and not restrictive in character. It should be understood that only the preferred embodiment has been shown and described and that all changes and modifications that come within the spirit of the invention are desired to be protected.

Since the rocket piston bounce gas pressure can yield at auto-ignition rates to match homogeneous or heterogeneous pressure without knock, the ideal internal combustion engine would combine spark and minimum temperature auto-ignition of any near-stoichiometric air fuel charge with about twelve-to-one compression ratio. The addition of an instant conversion rocket piston disc and bounce gas cushion to raise the combustion yield rate faster than combustion expansion rate making knock impossible as the rising pressure transfers all the available heat energy gas-to-gas compression and rocket piston yield in one millisecond up front, eliminating the current flywheel loss flame cooling time, and current NOx air pollution while doubling engine power efficiency.

This auto-ignition instant conversion gas-to-gas adiabatic expansion to a rocket piston bounce gas compression in one millisecond, then two piston compound expansion to exhaust with no flame for heat loss, has the highest expansion ratio and efficiency of any internal combustion engine due to the addition of a free piston gas-to-gas to mass instant conversion cycle at peak pressure with one new working disk piston check valve to separate combustion gas from bounce gas with infinite service life.

What is claimed is:

1. The improvement to the crown of a crank piston reciprocating within a cylinder of an internal combustion engine comprising:

a valve seat mounted to the piston crown to define a chamber therebetween, the valve seat including a plate closing said chamber, said plate defining a plurality of ports therethrough for permitting communication of combustion gas between the engine cylinder and said chamber; and a piston disc sized to translate within said chamber in response to combustion gas passing through said ports.

2. The improvement to the crank piston according to claim 1, wherein said plate is circular and includes a port at the center thereof and a further plurality of ports distributed about said center.

3. The improvement to the crank piston according to claim 1, wherein said plate is circular with all of said plurality of ports distributed about the center of said plate.

4. The improvement to the crank piston according to claim 1, further comprising an alignment member disposed within said chamber between said piston disc and the piston crown and operable to support said piston disc within said chamber.

5. The improvement to the crank piston according to claim 4, wherein said alignment member includes a conical spring.

6. The improvement to the crank piston according to claim 1, wherein said piston disc is formed of a heat-resistant metal.

7. The improvement to the crank piston according to claim 6, wherein said metal is chrome-nickel, stainless steel, or titanium material.

8. The improvement to the crank piston according to claim 1, wherein said piston disc has a thickness of about 0.05–0.06 inches (1.27–1.52 mm.).

9. The improvement to the crank piston according to claim 1, wherein:

the crown of the crank piston defines a recess, said recess defining at least a portion of said chamber; and said plate and said recess are configured for threaded engagement to mount said plate to the crown of the crank piston.

10. The improvement to the crank piston according to claim 9, wherein:

said valve seat includes a circumferential wall integral with said plate, said wall configured for mounting within said recess.

11. The improvement to the crank piston according to claim 1, wherein said plate defines a recess at the underside of the plate facing said piston disc.

12. The improvement to the crank piston according to claim 1, further comprising:

the crown of the crank piston defining a first recess, said first recess defining at least a portion of said chamber, and the crown further defining a second recess between said chamber and the crown; and a spring member disposed within said second recess and positioned to act on said piston disc when said disc bottoms on said first recess.

13. The improvement to the crank piston according to claim 1, wherein said piston disc is sized to permit combustion gas to leak around said disc within said chamber.

14. A crank piston for reciprocation within a cylinder of an internal combustion engine, the crank piston comprising:

a piston body having a crown;

a recess defined in the crown of the crank piston, said recess defining a chamber therein;

a valve plate closing said chamber, said valve plate including a number of ports defined therethrough to permit communication of combustion gas between the engine cylinder and said chamber; and a piston disc reciprocatably disposed within said chamber and sized relative to said recess to permit combustion gas to leak past said piston disc to define a bounce gas volume between said piston disc and the crown of the crank piston.

15. The improvement to the crank piston according to claim 14, further comprising a spring disposed within said chamber between said piston disc and the piston crown and operable to support said piston disc within said chamber.

16. The improvement to the crank piston according to claim 14, wherein said piston disc has a thickness of about 0.05–0.06 inches (1.27–1.52 mm.).

17. An improvement to the combustion cycle of an internal combustion engine comprising the steps of:

providing a crank piston defining a gas chamber in the crown of the piston, closed at one end by a ported valve plate, and including a piston disc reciprocatingly disposed within the gas chamber;

forming a bounce gas cushion beneath the disc by leaking combustion gas around the disc;

increasing the combustion volume by directing pressurized combustion gas through the ported valve plate to push the piston disc downward against the bounce gas cushion.

18. The improvement to the combustion cycle according to claim 17, further comprising the subsequent step of driving the piston disc upward by the bounce gas cushion after the combustion is substantially complete within the engine cylinder.

19. The improvement to the combustion cycle according to claim 17, further comprising adjusting the pressure at which the piston disc is pushed downward against the bounce pressure.

20. The improvement to the combustion cycle according to claim 19, wherein the adjusting step includes introducing a spring between the piston disc and the crank piston crown.

* * * * *